United States Patent [19]

Albiez

[11] Patent Number: 4,995,683

[45] Date of Patent: Feb. 26, 1991

[54] DRAWER PROVIDED WITH GUIDE MEANS

[75] Inventor: Alfred Albiez, Langen, Austria

[73] Assignee: Alfit Gesellschaft m.b.H., Götzis, Austria

[21] Appl. No.: 392,937

[22] PCT Filed: Dec. 6, 1988

[86] PCT No.: PCT/AT88/00108

§ 371 Date: Aug. 2, 1989

§ 102(e) Date: Aug. 2, 1989

[87] PCT Pub. No.: WO89/05109

PCT Pub. Date: Jun. 15, 1989

[30] Foreign Application Priority Data

Dec. 7, 1987 [AT] Austria ..... 3212/87

[51] Int. Cl.[5] ..... A47B 88/00

[52] U.S. Cl. ..... 312/348.4

[58] Field of Search ..... 312/330.1, 348.1, 348.4, 312/341.1

[56] References Cited

U.S. PATENT DOCUMENTS

| | | | |
|---|---|---|---|
| 4,609,236 | 9/1986 | Twellmann | 312/330.1 |
| 4,846,538 | 7/1989 | Rock et al. | 312/330.1 |
| 4,850,659 | 7/1989 | Rock et al. | 312/330.1 X |

FOREIGN PATENT DOCUMENTS

| | | | |
|---|---|---|---|
| 3620450 | 1/1987 | Fed. Rep. of Germany | 312/348.4 |

*Primary Examiner*—Joseph Falk

*Attorney, Agent, or Firm*—Kurt Kelman

[57] ABSTRACT

In a drawer which is provided with guide means consisting of drawer rails and corpus rails, the side walls consist of side members (2), which are provided with the drawer rails (5). A front plate (1) of the drawer is secured by retaining angle members (19, 20), which have legs (19), which extend parallel to the side members and are adjustable in height by means of eccentrics (23). In order to permit an exact and quick adjustment of the front plate in its inclination and laterally and in height with simple means and without adversely affecting the interior of the front plate, which adjustment can be effected at closely spaced apart locations which are disposed adjacent to the side member and are easily accessible when the drawer has slightly been extended, an intermediate plate is adjustably mounted on the outside of the side member (2) and the retaining angle member is mounted on said intermediate plate (18) for a pivotal movement about a pivot (28), which extends parallel to the front plate and serves to adjust the inclination of the front plate (1). The retaining angle member is adapted to be fixed in position and is adjustable by an adjusting screw (28) for laterally adjusting the front plate (1). The adjusting eccentrics (23, 32) and the adjusting and clamping screws (25, 28) are operable from the outwardly facing side of the leg (19) of the retaining angle member. The adjusting means are entirely provided on the outside of the side members (2) and are protected.

13 Claims, 5 Drawing Sheets

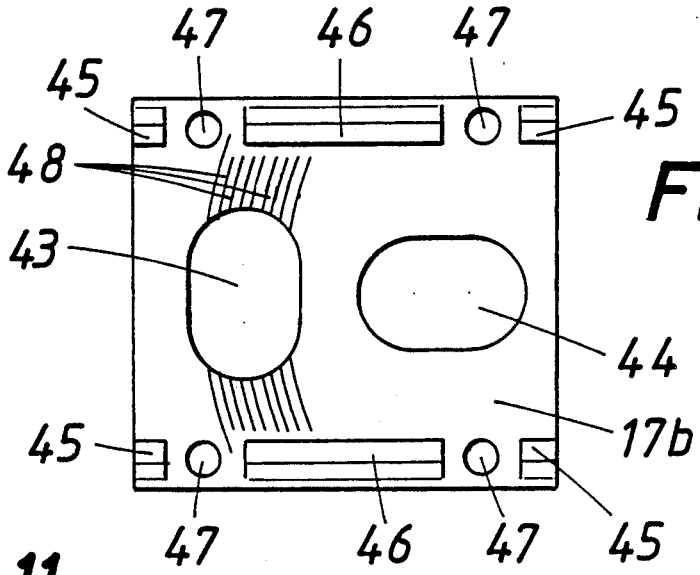
FIG.10
FIG.11
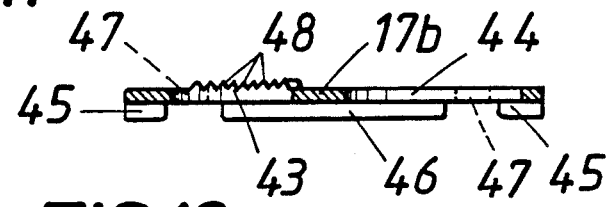
FIG.12
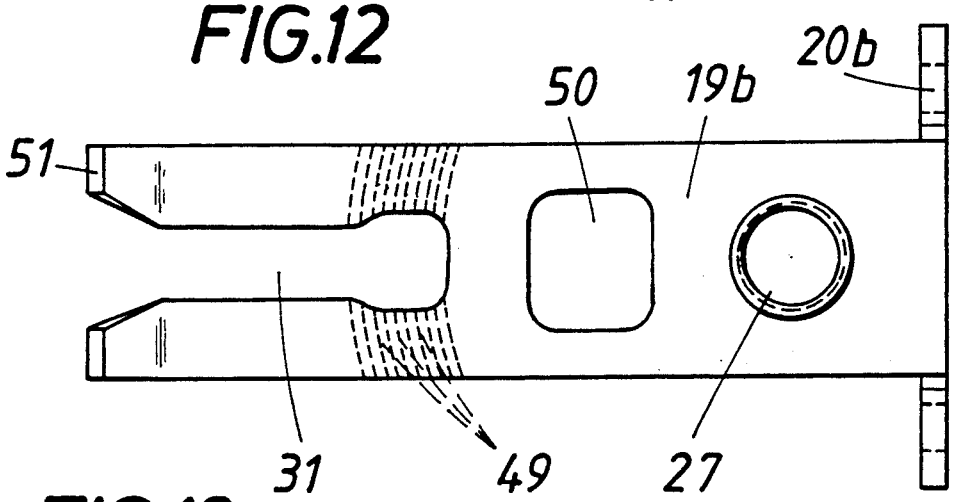
FIG.13
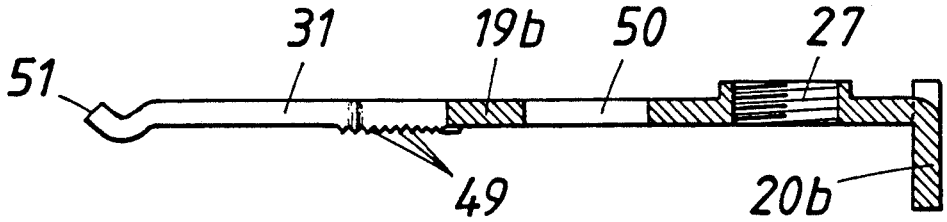

DRAWER PROVIDED WITH GUIDE MEANS

This invention relates to a drawer provided with guide means for opening and retracting the drawer between an open and closed position.

In such drawers, the drawer rails are preferably formed integrally with the side members and a rear wall of the drawer and a drawer bottom is secured to or supported on the side members. If drawers are juxtaposed or superimposed, the front plate, which constitutes a covering, is not exactly aligned inherently owing to manufacturing tolerances and inaccuracies in the assembly so that means for readjusting must be provided. Deviations in height, in the lateral adjustments and in the inclinations of the front plate may occur in practice and must be compensated if a uniform overall appearance of a finished piece of furniture or of a rack in a store is to be ensured.

Known adjusting means often permit a compensation only of a part of said faults from one location.

For an adjustment in height it is known that those legs of the retaining angle members which contact the side member can be secured to the side members by means of eccentrics and that the desired adjustment in height can be effected by the adjustment of said eccentrics. From AT-B 382,504 it is known that a retaining angle member which is secured to the side member can be adjusted in height on the front plate by means of a vertical adjusting screw and that additional retaining screws extending into slots may be used to secure the associated leg of the retaining angle member to the front plate.

In connection with eccentrics used for an adjustment, it is known that the side members may be double-walled and the eccentric may be accommodated in the cavity of the side member and an arrangement in which the means for fixing the carrying angle member of the front plate extend also into that cavity. In that case an expensive side member is required, which has a side opening that can be closed and which requires a relatively large space.

From DE-A1 37 11 756 it is known that carrying members extending over a major part of the height of the front plate can be attached to the front plate and inserted into slots of the side member. A relative adjustment in height may be effected by means of clamp screws. The inclination can only be adjusted by separate means.

From DE-A1 34 12 981 it is known to provide an upright angle member, which is connected to the front plate and extends over a major part of the height of said front plate, and to connect that angle member by resilient arms, which extend downwardly from the top end, and by sheet metal driving screws to a supporting structure, which is connected to the drawer bottom so that the front plate is laterally adjustable although that adjustment consists of a slightly pivotal adjustment about the upper fixing points of the arms. A similar design is known from DE-A1 34 23 925, where it is additionally possible to effect by means of eccentrics and slots a vertical adjustment of the arms, which are pivoted in that case, on the carrying angle members of the front plate.

In other designs, an adjustment of the inclination of the front plate has been permitted by means of a retaining angle member, which is adapted to be secured to the side member and has an upwardly protruding leg, which is directed toward the front plate and is pivoted about a transverse axis by means of a screw to a holder which is secured to the front plate. That design can be adopted only for side members which merely retain a bottom but do not constitute side walls.

DE-A1 34 23 732 discloses a design for effecting a lateral adjustment and an adjustment in height of the front plate. Cooperating wedge surfaces are provided on fixtures, which are separately to be mounted on the front plate and the side members, and the adjustments can be effected along said wedge surfaces. The cooperating fixtures can be fixed by fixing screws.

All known drawers which are of the kind described first hereinbefore and provided with means for adjusting the front plate have basic disadvantages. As has been mentioned, most designs permit only a part of the required adjustments to be effected from a single fixture so that adjustments must be effected at a plurality of locations, which are remote from each other; this renders the adjustment and readjustment more difficult. The parts of the adjusting means often protrude into the interior of the drawer. This is undesired because such protruding parts are disturbing in the use of the furniture and the stowage space in the drawer is decreased. Adjusting means which are accessible for an adjustment only from the top or from the interior of the drawer or from the top and from the sides are complicated and can be operated only when the drawer has been extended to a large extent so that it may possibly assume an inclined position, which differs from the final position. Finally, most known adjusting means involve the risk that the front plate once it has been adjusted will become loose as a result of impacts applied as the drawer is closed to that the front plate must then be readjusted. The design comprising double-walled side members which has been described has the disadvantage that the adjusting means are accessible only with difficulty, only expensive side members can be used and the free space in the drawer is reduced.

SUMMARY OF THE INVENTION

It is an object of the invention to provide a drawer which is of the stated kind and which permits the necessary adjustments of the front plate to be effected with simple means, quickly and exactly and wherein the adjusting means require only a small space and do not occupy a free space in the drawer and ensure a reliable fixation of the front plate.

The object set forth is accomplished with a drawer comprising two vertically extending side walls, a drawer rail affixed to the outside of each side wall and a guide rail cooperating with each drawer rail for substantially horizontally guiding the drawer rails along the guide rails. A vertical front plate extends transversely to the side walls and an angle member fixedly secures the front plate to each side wall below the rails, each angle member having one leg affixed to the front plate adjacent the side walls and another leg projecting inwardly from the front plate and extending parallel to the side walls. An intermediate plate is carried by each side wall at the outside thereof, an eccentric adjustment element engages each intermediate plate and is arranged for adjusting the vertical position of the intermediate plates with respect to the side walls and fixing the intermediate plates in the adjusted vertical position, an adjustment screw extends parallel to the front plate and is connected to the other leg of each angle member, the adjustment screw having an axial pivot portion extending parallel to the front plate and pivotally supporting the other angle member leg on a respective one of the intermediate plates for adjusting the inclination of the front plate affixed to the angle members, turning of the adjustment screw causing a lateral adjustment of the front plate with respect to the side walls, and at least one clamping screw fixes the front plate in the pivotally and laterally adjusted position, the adjustment element and screws as well as the clamping screws being operable from the outsides of the side walls.

In accordance therewith all parts of the adjusting means and of the retaining angle member are accommodated on the outside of the side wall in a space which otherwise would have to be kept free below the drawer rail of the side members. When the drawer has slightly been extended, the adjustable parts and particularly their adjusting means are laterally accessible from the outside of the drawer. All adjustments can be effected by adjusting means which are mounted at closely spaced apart locations. This means in practice that the necessary adjustments can be effected in much shorter times and more accurately than with the previously known designs.

According to a feature, wherein the adjustment screw has a screw-threaded portion screwed into a tapped hole in the other leg of the angle member and the axial pivot portion of the adjustment screw is rotatably and axially non-displaceably held in relation to the intermediate plate whereby the other angle member leg may pivot with respect to the intermediate plate and may be axially displaced by rotation of the screw-threaded portion in the tapped hole. In that case the pivot has a dual function.

If the adjustment of the retaining angle member is effected by another eccentric adjustment element movably mounted on the intermediate plate and extending into a slot in the other angle member leg at a distance from the axial pivot portion for pivoting the other angle member leg about the axial pivot portion, the eccentric adjustment element may engage, affords the advantage that the eccentric engages at an adequate distance from the pivotal axis so that there is an adequate supporting lever arm and shakes cannot effect an adjustment of the eccentric which has thus been mounted. The eccentric may be used for a sensitive adjustment of the angular position which is desired.

The clamping screw may be arranged to clamp the other angle member leg to the intermediate plate to be locked in the position to which it has been adjusted.

If the side members are thin-walled and/or if the function of the intermediate wall is to be performed by two elements, the drawer may further comprise a carrying plate secured to the outside of each side wall, each intermediate plate being secured to a respective one of the carrying plates. Simple means for fixing the carrying plate comprising a slot in the carrying plate supporting the eccentric adjustment element engaging each intermediate plate, and further comprising an offset retaining lug extending into the slot and arranged to engage a recess in the intermediate plate through an opening in the intermediate plate, the recess facing the carrying plate and the opening being dimensioned to permit the adjusting of the vertical position of the intermediate plate. In addition, the intermediate plate or carrying plate may partly be recessed if the side walls have an embossed portion for receiving the intermediate plates.

If the drawer further comprises bolts securing the carrying plates to the side walls to form two secured elements, the bolts being permanently attached to one of the secured elements and extending through an opening in the other secured element, the bolts may be welded to one element and riveted to the other element.

According to another preferred feature, the carrying plates and the other angle member legs are pivotal relative to each other for adjusting the inclination of the front plate, the carrying plates and the other angle member legs having confronting and interengaging profiled surface portions holding the other angle member legs in the pivoted position upon operation of the clamping screw. This produces the result that those parts of the adjusting means which are held together are rendered insensitive to an adjustment effected by impacts on the front plate, such as may always occur as the drawer is closed. If the profiled surface portions consist of like but opposite ridges and grooves extending concentrically in circles about the axial pivot portion, the adjustment lock will be maintained in any adjusted angular position.

The cover cap recited in claim 11 protects the adjusting means from being soiled and ensures a neat appearance of the drawer when it has been pulled out.

It is known per se to render the drawer self-retracting in that a run-in recess or a slope of the running surface for the inner roller that is secured to the drawer rail is provided at the inner end of the corpus rail. In known designs that slope extends only over one roller diameter, at most. A disadvantage resides in that the self-retraction causes the inner end of the drawer to be lowered so that the front plate is inclined and, as a result, can be adjusted only with difficulty because that adjustment can be effected only when the drawer has been extended in part.

Said disadvantages will be avoided if the drawer further comprises rollers mounted at opposite ends of the drawer and guide rails, respectively, for engagement with running surfaces of the rails, the running surfaces having sloping portions extending over a multiple of the diameter of the rollers, the guide rails having end stops for engaging the rollers mounted on the drawer rails and the sloping portions of the guide rails extending to the end stops, and the sloping portions of the drawer rails adjoining horizontal end sections of the drawer rail running surfaces, the end sections engaging the rollers mounted on the guide rails when the drawer is in a closed position whereby the drawer is self-retracting. Because the sloping surfaces are provided on both rails and are long and gentle, the drawer will not perform substantial tilting movements in its longitudinal direction. As the drawer rail has a horizontal end portion, an adjustment can be effected on the adjusting means when the drawer has slightly been extended so that the front plate can exactly be readjusted. The sloping portions of the running surfaces may merge into horizontal sections.

A design wherein each vertically extending side wall comprises a horizontally extending, inwardly projecting flange, the flanges being capable of supporting a bottom of the drawer, and the flanges defining a corner groove with the side walls facilitates the assembly because the bead or groove receives even a sharp bottom outer edge of the drawer bottom and it is no longer necessary to machine said edge in order to provide a chamfer or at least to cut off said edge.

Further details and advantages of the subject matter of the invention will become apparent from the following description of the drawing.

BRIEF DESCRIPTION OF THE DRAWING

Three illustrative embodiments of the invention are illustrated in the drawing, in which

FIG. 10 is a top plan view showing the carrying plate of different fixing means, FIG. 11 is a horizontal sectional view showing the carrying plate of FIG. 10, FIG. 12 is a top plan view showing a retaining angle member which can be used with the carrying plate shown in FIGS. 10 and 11 and FIG. 13 is a longitudinal sectional view showing the retaining angle member of FIG. 12. For the sake of clearness, FIGS. 10 to 13 are drawn to a larger scale than the remaining figures of the drawing.

DETAILED DESCRIPTION OF PREFERRED EMBODIMENTS

Figure 1:
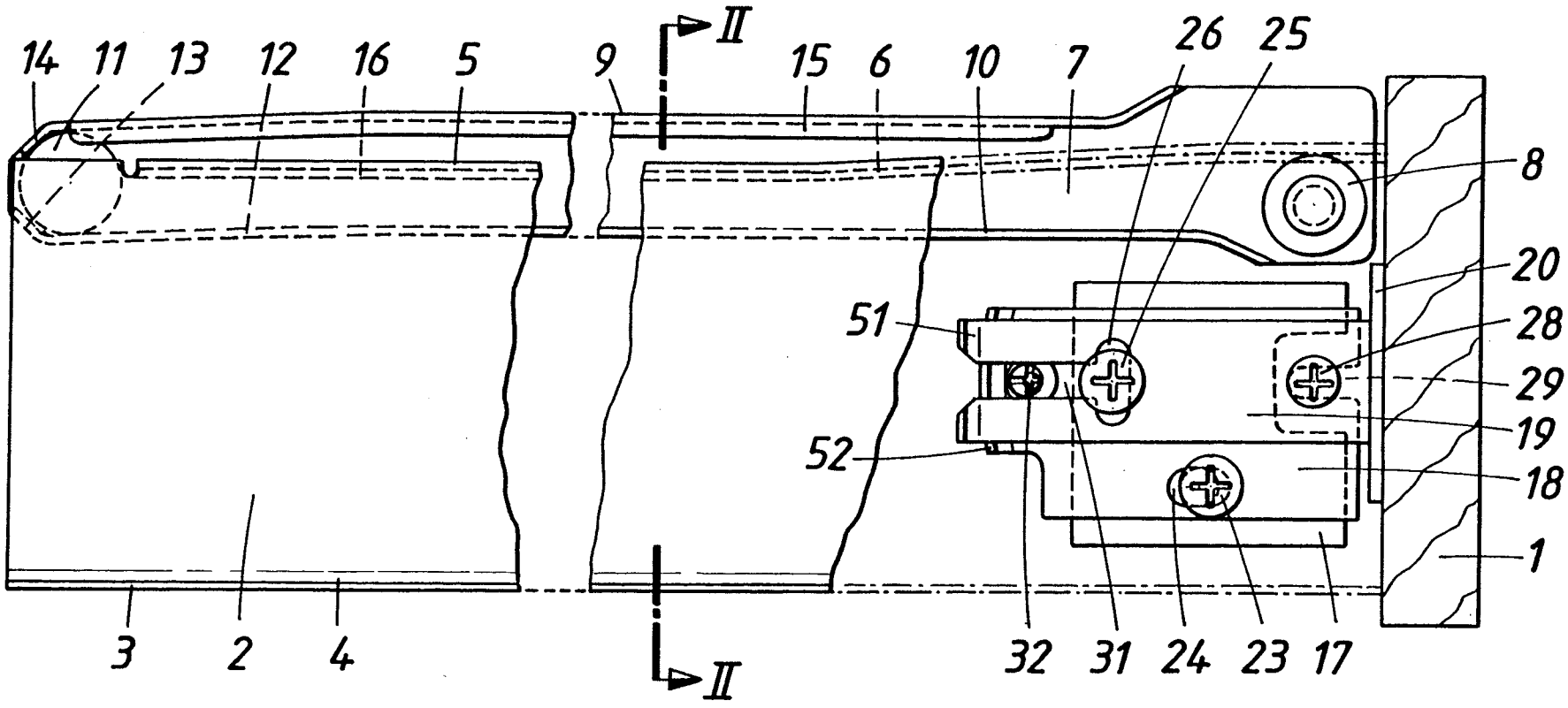
FIG. 1 shows a drawer in a longitudinal sectional view on a plane through the front plate part of the side member and, the bottom being omitted and the drawer being shown in its closed position.

In accordance with FIGS. 1 to 4, the front plate 1 and a side member 2 of a drawer are shown. The side member 2 constitutes one side wall of the drawer and has at its bottom an angled flange 3 for supporting a bottom. The flange 3 is integrally formed with formation of a corner bead 4 to provide a clearance for the edge of a bottom plate. A rear wall of the drawer may be secured to that bottom plate or to the side members 2.

The side member 2 is provided at its top with an angled flange 5, which has a downwardly facing side that constitutes a running surface 6 for a roller 8, which is mounted at the forward end of a guide rail 7. When the drawer is closed, that running surface 6 is approximately horizontal adjacent to the roller 8 and then merges into a forward sloping portion, which is succeeded by a long horizontal surface.

The guide rail 7 comprises a top flange 9 and a bottom flange 10, which have confronting sides, which constitute running surfaces for a roller 11, which is mounted on the rear end of the side member 2. The running surface of the flange 10 slopes toward both ends of the rail 7. The rear sloping surface 12 is succeeded by an end stop 13 of the bottom flange 10 facing end stop 14 of the top flange 9. The flanges 5 and 9 have depending guide edges 15, 16. The flange 9 of the rail 7 terminates at a distance from the roller 8 and in that region is raised in order to facilitate the insertion of the roller 11.

For a fixation of the front plate 1, the embodiment shown in FIGS. 1 to 4 comprises a retaining structure, which comprises a carrying plate 17 and an intermediate plate 18 for the fixation of one leg of a retaining angle member 19, 20. The leg 20 can be secured to the front plate 1 by means of screws, which extend into openings 21.

Figure 5:
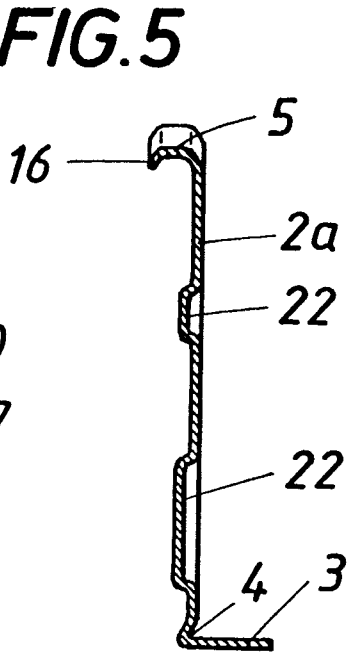
FIG. 5 is a longitudinal sectional view showing a modification of the side member of the embodiment shown in FIGS. 1 to 4.

The carrying plate 17 may be fixedly connected to the side member 2 and serves to guide the intermediate plate 18. In the embodiment shown in FIG. 5, the carrying plate has been replaced by embossed portions 22 of the side member 2*a*. The intermediate plate 18 has offset lateral portions, which are guided on the carrying plate 17 for an adjustment in height. An eccentric, which is adjustable by means of a screw head 23 and is supported in the plate 17, extends into a slot 24 in the intermediate plate 18, which has another slot, by which the intermediate plate 18 is guided on a screw 25, which is screwed into screw threads of the plate 17 and which extends also through a slot 26 in the leg 19 of the angle member. When the screw 26 has been loosened, the plate 18 can be adjusted in height by means of the eccentric 23 while the plate 18 is guided by the offsets of the intermediate plate 18.

A pivot 28 has a screw-threaded end portion, which is screwed into a tapped opening 27 of the retaining leg 19. The pivot has a constricted portion, which extends into a slot 29 of the plate 18. Behind said slot 29 the pivot 28 carries an enlarged head 30. By its constricted portion, the pivot 28 is axially undisplaceably secured to the part 18. The pivot 28 can be rotated by means of a cross-recessed head to adjust the leg 19 relative to the plates 17, 18 so that the front plate 1 can laterally be adjusted. An eccentric 32, which is also adjustable by means of a screwhead is movably mounted in the plate 18 and extends into a slot 31, which is formed in the leg 19 and extends from the slot 26. That eccentric 32 can be rotated to pivotally move the leg 19 and also the front plate about the pivot 28. When the adjustment in height and the lateral and pivotal adjustments have been effected, the entire adjustment is fixed in that the screw 25 is tightened so that an offset portion 51 of the retaining angle member 19 bears on a forwardly curved edge 52 of the intermediate plate 18.

Figure 4:
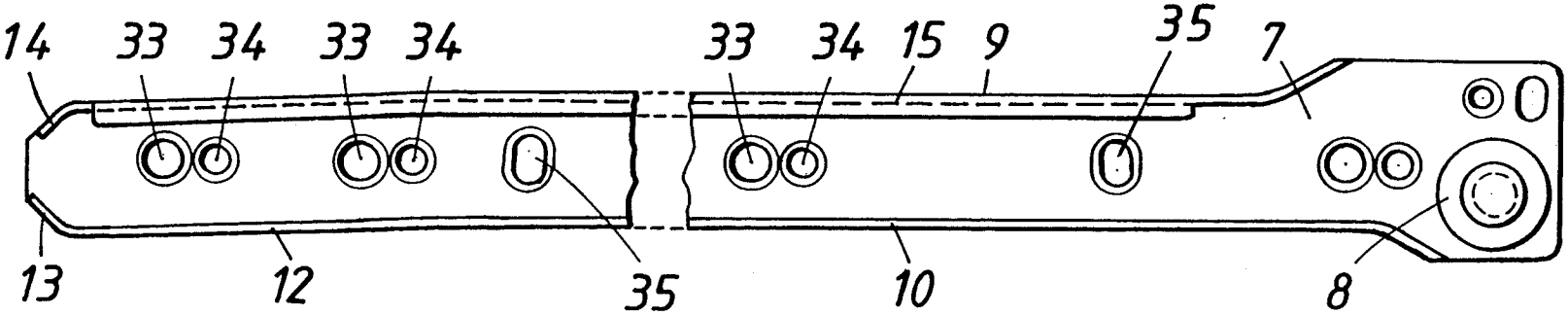
FIG. 4 is an elevation showing the guide rail which is associated with the embodiment of FIG. 1.
Figure 6:
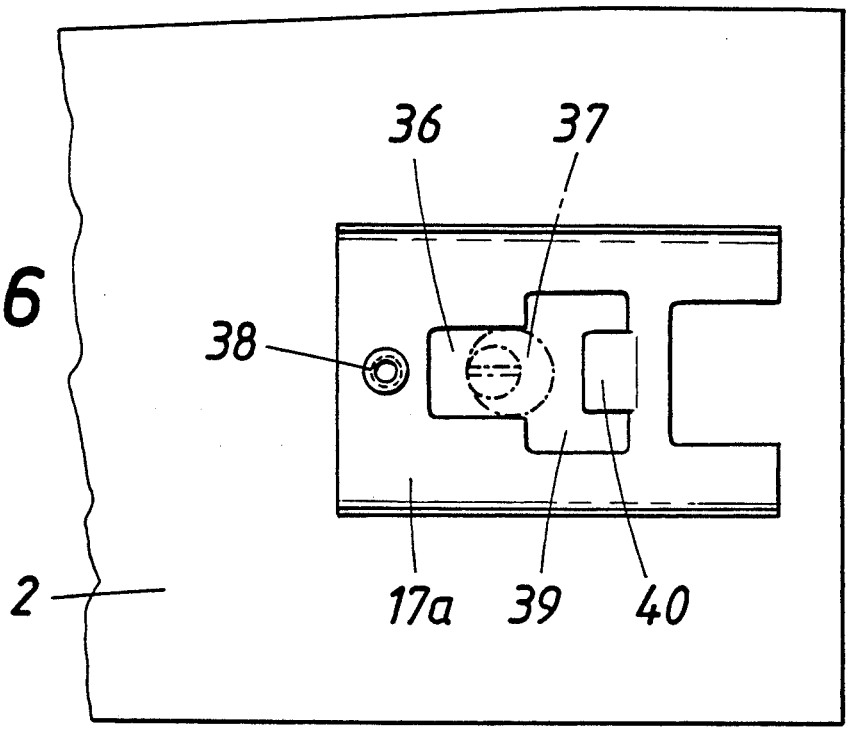
FIG. 6 shows for a further embodiment a side member and a carrying plate secured thereto.

It is shown in FIG. 4 that the guide rail 7 may have pairs of holes 33, 34 and slots 35 for receiving fixing screws. Screws which differ in size and are spaced different distances apart may be used owing to the illustrated arrangement of holes. The rims of the holes 33, 34, 35 may be outwardly or inwardly embossed in order to increase the stability and/or to receive the material which has been displaced by the screw as it is screwed in so that a snug engagement of the rail on the corpus is ensured.

In the adjusting means the plate 18 might be pivoted to the plate 17 by suitable means and an adjustment on height of the plate 19 relative to the plate 18 might be permitted. But in that case the lateral adjustment effected by a pivot 28 consisting of a screw is no longer so simple as in the illustrated embodiment.

Because the adjusting means should not be exposed, it is contemplated to provide a cover cap, which extends over the parts 17, 18, 19 and is preferably slidably fitted on the part 17. That cap may consist of various materials and preferably consists of an extruded or injection-molded part. It may also serve as an advertising surface or as a surface which can be provided with an inscription.

Figure 3:
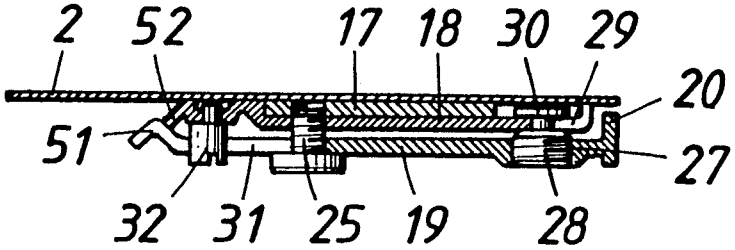
FIG. 3 is a horizontal sectional view showing the fixing means.
Figure 2:
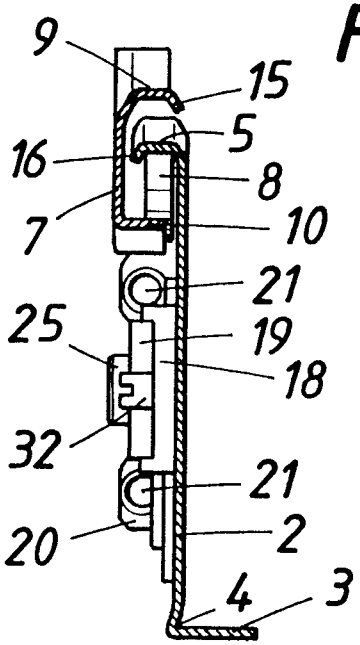
FIG. 2 is a sectional view taken on line II—II in FIG. 1.

In FIGS. 6 to 9, the carrying plate, the intermediate plate and the angle member have been provided with the same reference characters as in FIGS. 1 to 3, with the suffix a. The remaining reference characters are unchanged. The carrying plate 17*a* is secured to the side member 2 and has a slot 36 for supporting an adjusting eccentric 37 and also has a tapped bore 38 for receiving the clamp screw 25. The slot 36 is succeeded by an enlarged opening 39, from which an offset lug 40 extends over the rim of the hole. That lug 40 can be engaged through a hole 42 with a cooperating lug 41 on the intermediate plate 18*a*. The adjustments which are possible again correspond to those of the preceding figures. Compared with the embodiment shown in FIGS. 1 to 3, the embodiment shown in FIGS. 6 to 9 affords the advantage that it is somewhat more compact and can more easily be operated. In that case too, all adjustments can be effected by means of juxtaposed actuating heads, which have screwhead recesses or cross recesses.

In accordance with FIGS. 10 to 13, a baseplate 17*b* is provided, which has two holes 43, 44. The base plate 17*b* has embossed portions 45, 46, which are supported on the side member, and has openings 47 for receiving fixing bolts, which are secured to the side member, e.g., by welding. When the carrying plate 17*b* has been placed onto the side member, said fixing bolts are, e.g., riveted.

Figure 7:
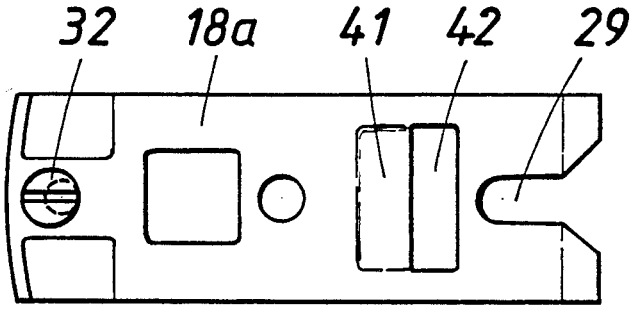
FIG. 7 shows the associated partition plate.
Figure 8:
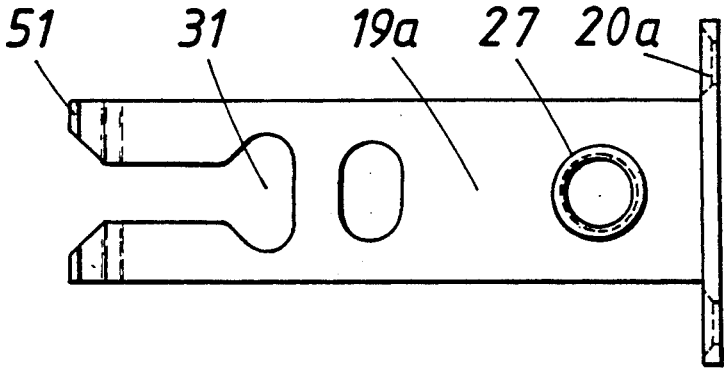
FIG. 8 shows the associated retaining angle member.
Figure 9:
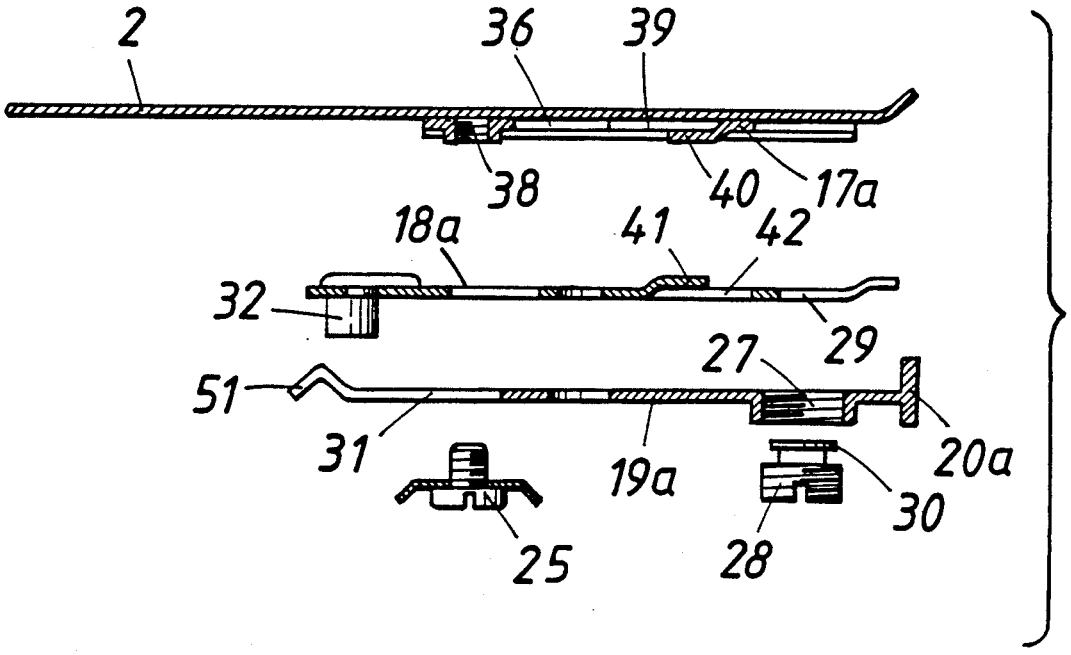
FIG. 9 is an exploded sectional view showing the fixing means consisting of the parts illustrated in FIGS. 6 to 8.

A retaining angle member 19*b*, 20*b* may be placed on the carrying plate with an intermediate plate like that designated 18*a* in FIG. 7 interposed but without a hole 41 and a lug 42. The confronting and mutually contacting surfaces of the carrying plate 17*b*, the intermediate plate and the leg 19*b* of the angle member are provided with interfitting ribs and grooves 48, 49, which are, e.g., triangular in cross-section and are concentric about the center of the hole 27 and of the pivot for adjusting the inclination. As a result, a guidance will be provided during the pivotal adjustment and the fixation of the retaining angle member 19*b*. When the fixture has been clamped in position the interengagement of said grooves and ribs ensure that impacts acting on the adjusted front plate of the drawer, which front plate has been secured by the leg 20*b* of the angle member, will result in a relative displacement, i.e., in a change of the adjustment and readjustment which have been effected. The profiled portions 48, 49 will be able to take up relatively strong shocks. The eccentric for adjusting the inclination extends into the hole 43 and the eccentric for the adjustment in height extends into the hole 44. Said adjusting eccentrics are accessible through the opening 31 and through an opening 50 in the leg 19*b* of the angle member. In that case too, a cover cap may be provided for the entire adjusting means, which cover cap extends also over the leg 20*b* of the retaining angle member and is adapted to be slidably fitted or to be snapped on, e.g., from the left.

I claim:

1. A drawer comprising (a) two vertically extending side walls, (b) a drawer rail affixed to the outside of each side wall, (c) a guide rail cooperating with each drawer rail for substantially horizontally guiding the drawer rails along the guide rails, (d) a vertical front plate extending transversely to the side walls, (e) an angle member fixedly securing the front plate to each side wall below the rails, each angle member having (1) one leg affixed to the front plate adjacent the side walls and (2) another leg projecting inwardly from the front plate and extending parallel to the side walls, (f) an intermediate plate carried by each side wall at the outside thereof, (g) an eccentric adjustment element engaging each intermediate plate and arranged for adjusting the vertical position of the intermediate plates with respect to the side walls and fixing the intermediate plates in the adjusted vertical position, (h) an adjustment screw extending parallel to the front plate and connected to the other leg of each angle member, the adjustment screw having an axial pivot portion extending parallel to the front plate and pivotally supporting the other angle member leg on the respective intermediate plate for adjusting the inclination of the front plate affixed to the angle members, turning of the adjustment screw causing a lateral adjustment of the front plate with respect to the side walls, and (i) at least one clamping screw for fixing the front plate in the pivotally and laterally adjusted position, the adjustment element and screws as well as the clamping screws being operable from the outsides of the side walls.

2. The drawer of claim 1, wherein the adjustment screw has a screw-threaded portion screwed into a tapped hole in the other leg of the angle member and the axial pivot portion of the adjustment screw is rotatably and axially non-displaceably held in relation to the intermediate plate whereby the other angle member leg may pivot with respect to the intermediate plate and may be axially displaced by rotation of the screw-threaded portion in the tapped hole.

3. The drawer of claim 1, further comprising another eccentric adjustment element movably mounted on the intermediate plate and extending into a slot in the other angle member leg at a distance from the axial pivot portion for pivoting the other angle member leg about the axial pivot portion.

4. The drawer of claim 1, wherein the clamping screw is arranged to clamp the other angle member leg to the intermediate plate.

5. The drawer of claim 1, wherein the side walls have an embossed portion carrying the intermediate plates.

6. The drawer of claim 1, further comprising a carrying plate secured to the outside of each side wall, each intermediate plate being secured to a respective one of the carrying plates.

7. The drawer of claim 6, wherein a slot in the carrying plate supports the eccentric adjustment element engaging each intermediate plate, and further comprising an offset retaining lug extending into the slot and arranged to engage a recess in the intermediate plate through an opening in the intermediate plate, the recess facing the carrying plate and the opening being dimensioned to permit the adjusting of the vertical position of the intermediate plate.

8. The drawer of claim 6, further comprising bolts securing the carrying plates to the side walls to form two secured elements, the bolts being permanently attached to one of the secured elements and extending through an opening in the other secured element.

9. The drawer of claim 6, wherein the carrying plates and the other angle member legs are pivotal relative to each other for adjusting the inclination of the front plate, the carrying plates and the other angle member legs having confronting and interengaging profiled surface portions holding the other angle member legs in the pivoted position upon operation of the clamping screw.

10. The drawer of claim 9, wherein the profiled surface portions consist of like but opposite ridges and grooves extending concentrically in circles about the axial pivot portion.

11. The drawer of claim 1, further comprising rollers mounted at opposite ends of the drawer and guide rails, respectively, for engagement with running surfaces of the rails, the running surfaces having sloping portions extending over a multiple of the diameter of the rollers, the guide rails having ends stops for engaging the rollers mounted on the drawer rails and the sloping portions of the guide rails extending to the end stops, and the sloping portions of the drawer rails adjoining horizontal end sections of the drawer rail running surfaces, the end sections engaging the rollers mounted on the guide rails when the drawer is in a closed position whereby the drawer is self-retracting.

12. The drawer of claim 11, wherein the sloping portions of the running surfaces merge into horizontal sections.

13. The drawer of claim 1, wherein each vertically extending side wall comprises a horizontally extending, inwardly projecting flange, the flanges being capable of supporting a bottom of the drawer, and the flanges defining a corner groove with the side walls.

* * * * *